United States Patent [19]

Gould et al.

[11] Patent Number: 4,685,892

[45] Date of Patent: Aug. 11, 1987

[54] TOY CONSTRUCTION SET

[75] Inventors: Diane C. Gould, El Segundo; Robert R. Tucker, Redondo Beach, both of Calif.

[73] Assignee: Mattel, Inc., Hawthorne, Calif.

[21] Appl. No.: 777,655

[22] Filed: Sep. 19, 1985

[51] Int. Cl.[4] ..... A63H 33/08

[52] U.S. Cl. ..... 446/109; 446/95; 446/115; 446/116; 52/DIG. 10; 52/591

[58] Field of Search ..... 446/116, 115, 109, 108, 446/120, 121, 125, 128, 95, 107; 52/DIG. 10, 591, 594

[56] References Cited

U.S. PATENT DOCUMENTS

| | | | |
|---|---|---|---|
| 311,793 | 2/1885 | Stranders . | |
| 1,623,641 | 4/1927 | Sixta . | |
| 2,061,510 | 11/1936 | Drumpelmann | 446/116 X |
| 2,676,420 | 4/1954 | Berg . | |
| 3,315,375 | 4/1967 | Nielsen | 446/120 X |
| 3,566,531 | 3/1971 | Hasel et al. . | |
| 3,594,940 | 7/1971 | Yonezawa | 446/108 X |
| 3,777,393 | 12/1973 | Baer . | |
| 3,852,909 | 12/1974 | Viebcke . | |
| 4,209,934 | 7/1980 | Ogawa . | |
| 4,242,767 | 1/1981 | McMullen et al. | 446/121 X |
| 4,509,930 | 4/1985 | Schweigert et al. | 446/116 X |

FOREIGN PATENT DOCUMENTS

| | | | |
|---|---|---|---|
| 2720641 | 11/1977 | Fed. Rep. of Germany | 446/95 |
| 5832 | of 1914 | United Kingdom . | |

*Primary Examiner*—Mickey Yu

*Attorney, Agent, or Firm*—Ronald M. Goldman; Melvin A. Klein; Daniel F. Sullivan

[57] ABSTRACT

A toy construction set having a plurality of generally planar geometrically configured unitary multi-sided construction elements, with each side having a tab connected thereto with living hinges, each tab including an aligned pair of connectors, each connector including a generally cup-shaped protuberance, the exterior forming a male connector or pin and the interior forming a female connector or well. Adjacent connectors on a given tab are inverted relative to one another. A shaft member is provided with one end having a pin and the other end having a wall. A wheel carrying member is provided with horseshoe-shaped clip portions for engaging the periphery of the shaft member.

4 Claims, 13 Drawing Figures

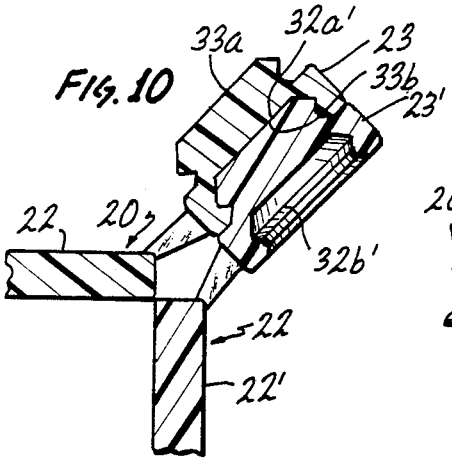
FIG. 10
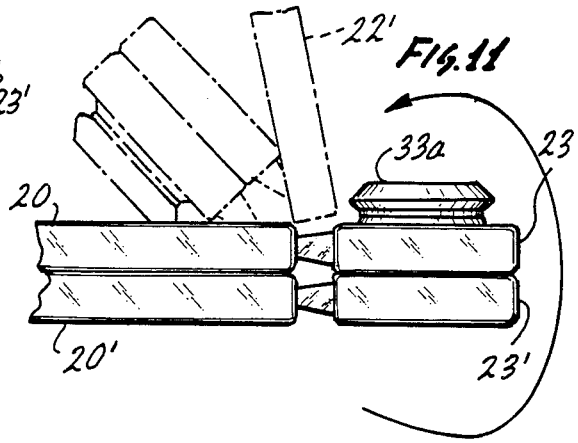
FIG. 11
FIG. 12
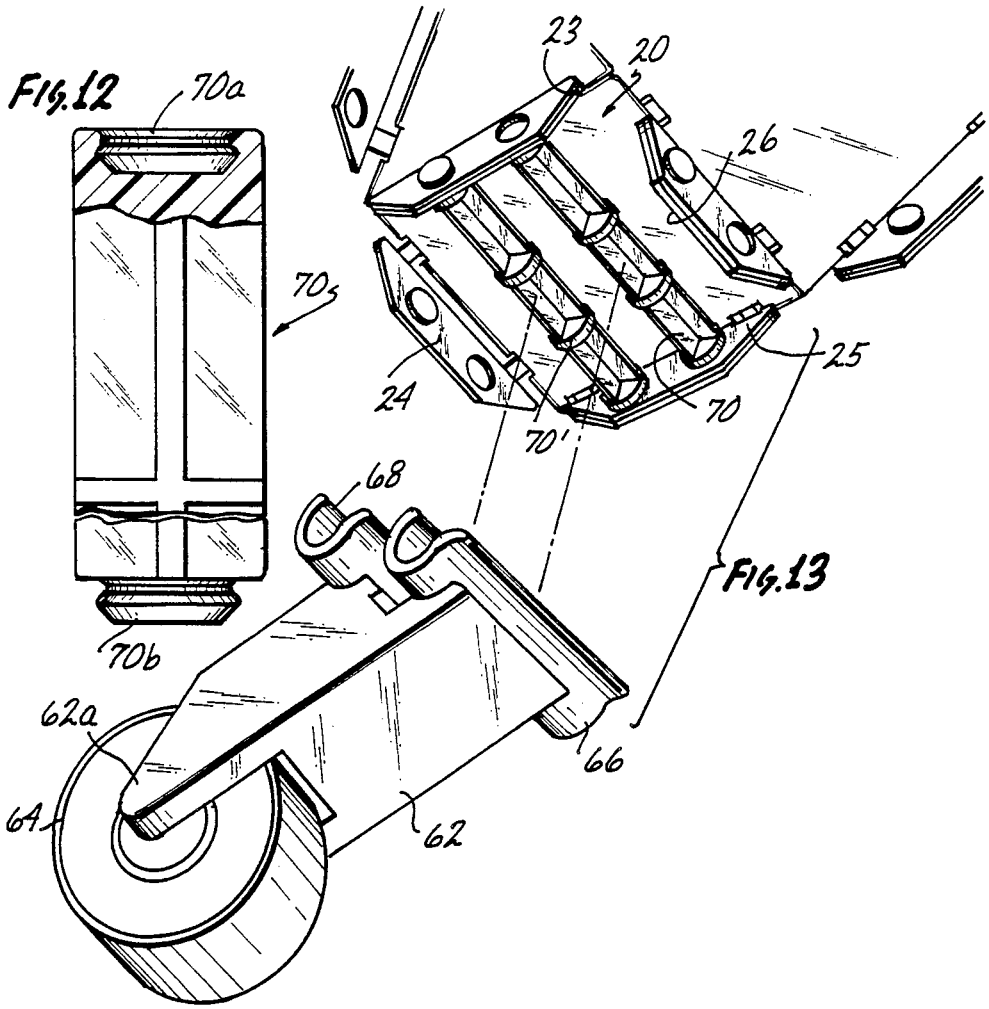
FIG. 13

TOY CONSTRUCTION SET

BACKGROUND OF THE INVENTION

The background of the invention will be discussed in two parts:

1. Field of the Invention

This invention relates to toy construction sets, and more particularly to interlocking structural components thereof with integrally formed hinge and interlock elements.

2. Description of the Prior Art

Toy construction sets for enabling the creation of simulated animate and inanimate objects have been a source of amusement for decades, particularly the types of toy construction sets with various types and configurations of interlocking components that enable formation of wheeled vehicles as well.

One such early construction toy is shown and described in U.S. Pat. No. 311,793, issued Feb. 3, 1895, to Stranders for a "Building Toy", such patent showing a set including connectable dowel rods and partitions capable of being assembled into a structure depicting a building.

Another set using interconnectable panels or partitions is shown and described in U.S. Pat. No. 1,623,641, entitled "Structure Building Card", issued to Sixta on Apr. 5, 1927, the interconnecting means including flat members insertable into staple members on adjacent panel edges.

U.S. Pat. No. 2,676,420 is directed to "Model Building Construction", such patent being issued to Berg on Apr. 27, 1954, the construction being intended for use to illustrate the floor and column arrangement of a full-size building together with the disposition of model machines or other items of equipment or furniture.

U.S. Pat. No. 3,566,531, entitled "Mating Blocks Having Beaded Studs and Resilient Sidewalls", issued to Hasel et al on Mar. 2, 1971, such patent disclosing hollow box-like toy blocks open on the lower side and having studs on the upper side to mate with the open side, the lower sidewalls being resilient and the studs may have beads.

Another such set is shown and described in U.S. Pat. No. 3,777,393, issued to Baer, on Dec. 11, 1973, such patent being entitled "Construction Toy", the toy including a plurality of unitary construction members, each having two wing-shaped elements joined by a hinge at the longitudinal axis of the member and two hinges in each end of the member. Each member is provided with an array of holes and an array of pins for enabling interconnection into three-dimensional geometric configurations.

Another such toy construction system is shown in U.S. Pat. No. 3,852,909, issued Dec. 10, 1974 to Viebcke, for "Blocks With Detachable Cap Plates Having Additional Mating Connecting Means", the patent disclosing construction elements formed as a closed frame having grooved outer surfaces and tongue-like connector elements sloped with respect to the plane of the frame, the open sides being capable of being covered by respective cap plates with or without connector elements.

U.S. Pat. No. 4,209,934, was issued to Ogawa, on July 1, 1980, and is entitled "Modular Toy Building Units", the patent disclosing a set including geometrically configured panels having a pair of apertures adjacent each edge with connector elements having two pairs of spaced mounting posts for interconnection to the apertures. The connector members may be provided with living hinges to enable angular positioning of one panel relative to the other after connection.

British Pat. No. 5832, accepted July 30, 1914, is entitled "Improvements in and Relating to Toy Building-Outfits", and discloses girder-like members and connector members having bent over interlocking portions.

It is an object of the present invention to provide a new and improved toy construction set.

It is another object of the present invention to provide new and improved construction elements for a toy construction set.

It is a further object of the present invention to provide a new and improved unitary construction element having a generally planar configuration with integrally formed hinges and connection means.

SUMMARY OF THE INVENTION

The foregoing and other objects are accomplished by providing a toy construction set having a plurality of generally planar geometrically configured unitary multi-sided construction elements, with each element having, along each side, a trapezoidally configured tab connected thereto with living hinges, each tab including an aligned pair of connectors, each connector including a generally cup-shaped protuberance, the exterior forming a male connector or pin on one surface of the tab and the interior forming a female connector or well on the other surface. Adjacent connectors on a given tab are inverted relative to one another. A shaft member is provided with one end thereof having a pin and the other end having an axially aligned well. A wheel carrying member is provided with horseshoe-shaped clip portions for engaging the periphery of the shaft member.

Other objects, features and advantages of the invention will become apparent from a reading of the specification, when taken in conjunction with the drawings, in which like reference numerals refer to like elements in the several views.

BRIEF DESCRIPTION OF THE DRAWINGS

FIG. 10 is a cross-sectional view of a portion of the interconnected construction elements of FIG. 9 as viewed generally along line 10 thereof with one of the construction elements pivoted 180 degrees relative to the other;

FIG. 11 is an end view of two interconnected construction elements with dotted lines depicting the extent of relative pivoting;

FIG. 12 is a plan view, partially broken away, of the shaft member construction element according to the invention; and FIG. 13 is an exploded view of a portion of the wheeled vehicle of FIG. 1 illustrating the interconnection of the wheel member to the shaft members.

DESCRIPTION OF THE PREFERRED EMBODIMENT

Figure 1:
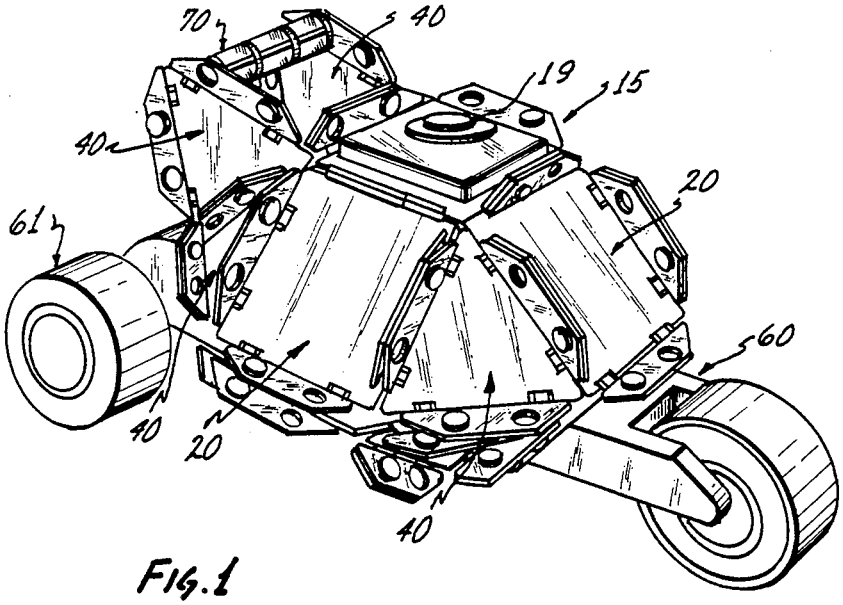
FIG. 1 is a perspective view of a wheeled vehicle constructed with the toy construction set in accordance with the present invention.
Figure 2:
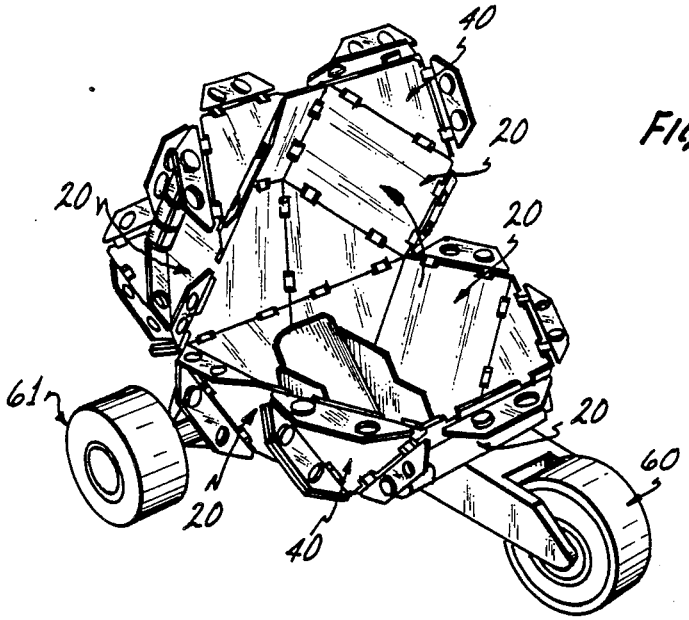
FIG. 2 is a perspective view of the wheeled vehicle of FIG. 1 with a portion thereof hinged upwardly.

Referring now to the drawings, and particularly to FIGS. 1 and 2, there is shown a toy wheeled vehicle, generally designated 15, formed of a plurality of construction elements in accordance with the invention. The construction elements include element 20 (See also FIG. 3) which is a generally planar member of generally uniform thickness having a generally rectangular, or square, main body portion 22 and four integrally formed tabs 23–26 hingedly coupled to the sides 22*a*–22*d* thereof. Each tab 23–26 is of a trapezoidal configuration with a pair of "living" hinges 23*a*, 23*b*, 24*a*, 24*b*, etc., interconnecting the tab 23–26 to the sides 22*a*–22*d*, respectively, of the main body portion 22.

The wheeled vehicle 15 utilizes a second construction element 40 (See FIG. 5) of generally triangular configuration, wheel members generally designated 60 and 61 and shaft members, generally designated 70. As will be described, the various construction elements 20 and 40 are configured and dimensioned for interlocking engagement and pivotable positionable relation to construct, along with additional construction elements 60, 61 and 70, a myriad of simulated animate and inanimate objects such as the toy vehicle 15.

For simplicity, and in order to minimize the number of plate-like construction elements for the toy construction set, the main body portion 42 of triangular element 40 is formed as an equilateral triangle, and the main body portion 22 of element 20 is formed as a square having a side 22*a* the same length as the side 40*a*, 40*b* or 40*c* of the triangular main body portion 42 of element 40. The shaft elements 70 have an axial length generally equal to the length of this side, and such shaft elements 70 may be used for structural reinforcement as well as for coupling of the wheel members 60 and 61. Elements of right or isoceles triangular configuration as well as rectangular configuration may be readily constructed in accordance with the invention, but the varying length of sides would increase the complexity of, and skill required for construction of objects. In any event, the various elements may be readily interconnected to form a hollow geometric enclosure such as the vehicle 15 shown in FIGS. 1 and 2.

Referring now to FIGS. 3 through 8, the element 20 includes a generally square main body portion 22 having tabs 23–26 extending from the sides 22*a*–22*d* thereof. By reference to tab 23, depicted in various cross-sectional views in FIGS. 5 through 8, the connection of the tab 23 to the side 22*a* of the main body portion 22 is by means of first and second living hinges 27, 28 of reduced thickness formed integrally with the main body portion 22 and each of the tabs 23–26.

Such "living" hinges 27, 28 are well known in the plastics manufacturing art and are essentially reduced thickness or necked down sections of plastic material that has a minimum amount of plastic memory, such hinges being capable of a very large number of repeated flexings without failure.

Figure 5:
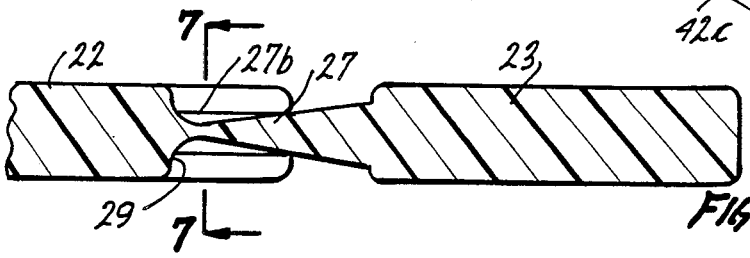
FIG. 5 is a cross-sectional view of a portion of the construction element of FIG. 3 as viewed generally along line 5—5 thereof.

The hinges 27, 28 are formed within first and second recessed portions 29, 30, respectively, of the side 22*a*, and, as shown in FIG. 5, the hinge 27 is tapered in cross-section, tapering from a thicker section at the junction with tab 23 to a very thin section at the junction with the main body portion 22 at the base of the recess 29. As shown, the thickness of the tab 23 is generally equal to the thickess of the main body portion 22, with the upper and lower surfaces of the tab 23 and body portion 22 generally coplanar with the hinge 27 unflexed.

The tab 23, as well as tabs 24–26, are formed in a trapezoidal configuration which includes a long base side 23*a*, a short base side 23*b* and angled ends 23*c* and 23*d*, both having the same angle of inclusion of approximately 35 degrees with the long base side 23*a*. The length of the long base side 23*a* is slightly less than the length of the adjacent side 22*a* of the main body portion 22, with tab 23 positioned generally centrally relative to side 22*a*. By way of example, and not of limitation, with a side 22*a* of 2.20 inches, the length of long base side 23*a* is 1.840 inches. The spacing between side 22*a* of the main body portion 22 and the long base side 23*a* of tab 23 is approximately 0.065 inch. The width of the hinges 27, 28 is 0.150 inch, and the thickness thereof tapers from 0.120 inch to approximately 0.056 inch, with the thickness of the tab 23 of approximately 0.075 inch. The recesses 29 and 30 have a depth of approximately 0.085 inch. By reference to FIG. 7, at about the least thickness section of the hinge 27, the hinge 27 is somewhat H-shaped in cross-section with the lateral edges 27*a* and 27*b* thereof of greater thickness to provide a greater resistance to failure while providing minimal additional force for flexing.

The reduced length of the long base side 23*a* and the angle of the ends 23*c* and 23*d* relative to the long base side 23*a*, permit angular displacement of one construction element relative to an interconnected element through angles between zero degrees and approximately 290 degrees if the sides perpendicular to the hinged side are not interconnected to other construction elements.

Each tab, such as tab 23, includes integrally formed connector means, such connector means being in the form of cup-shaped connectors 32 and 33, with adjacent connectors being in inverted relation to one another. For example, by reference to the exposed surface of tab 23 in FIG. 3, the connector 32 has the open end thereof on this surface, forming a well 32*a*, while connector 33 has the closed end thereof forming a protuberance extending up from the surface, this protuberance forming a pin 33*b* for interconnection with a well similar to the well 32*a*.

Figure 6:
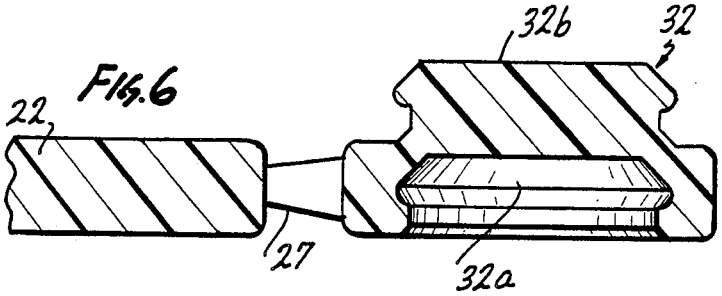
FIG. 6 is a cross-sectional view of a portion of the construction element of FIG. 3 as viewed generally along line 6—6 thereof.
Figure 7:
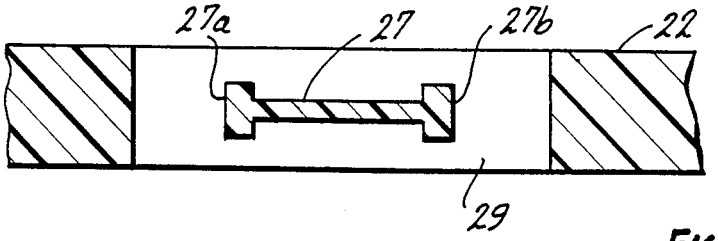
FIG. 7 is a cross-sectional view of a portion of the construction element of FIG. 3 as viewed generally along line 7—7 of FIG. 5.

By referring to FIG. 6, it can be seen that the connector 32 has a pin portion 32*b* and a well portion 32*a* in axially aligned relation, with the cross-sectional configuration of the pin 32*b* being generally identical to the cross-sectional configuration of the well 32*a* for snap-lock interengagement. In cross-section, both the well 32*b* and the pin 32*b* are generally mushroom-shaped. The pin 32*b* has a shaft portion with an enlarged diameter peripheral flange, the flange having a tapered peripheral edge on the upper surface thereof to faciliate insertion, with the taper being approximately 45 degrees. Similarly the well 32*a* is matingly configured and has an enlarged diameter upper recess portion with a tapered upper peripheral surface and a reduced diameter opening therebelow, with the edge adjacent the opening thereof tapered at about 45 degrees to facilitate insertion of a coacting pin.

The alternating of the relative positions of the pins and wells of adjacent connectors 32 and 33 on the same tab 23, and the alternating of pins and wells about the periphery from tab to tab provides a means of minimizing positioning problems of interconnection of construction elements 20 and 40 with other like elements.

Figure 3:
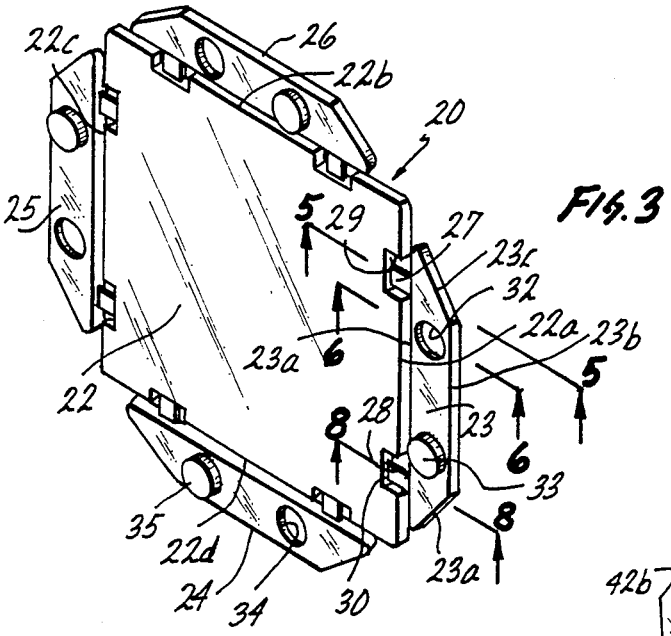
FIG. 3 is a perspective view of one of the construction elements used in constructing the wheeled vehicle of FIG. 1.

By reference to FIG. 3, adjacent tabs 23 and 24 have the connectors formed thereon so that the pins and wells alternate about the perimeter of the construction element 20, that is, in a clockwise direction, on the same surface, tab 23 has first a well of connector 32, then a pin of connector 33, with tab 24 having first a well of connector 34, and then a pin of connector 35. In this manner, when two construction elements, such as two elements 20 are being interconnected, it is irrelevant which two tabs are interconnected, and with both surfaces being identically configured, surface positioning is not a problem. In this latter regard, viewing the construction element 20 of FIG. 3, if it were to be rotated about a vertical or horizontal axis through the center thereof, the exposed surface would still be the same as that in FIG. 3.

Figure 4:
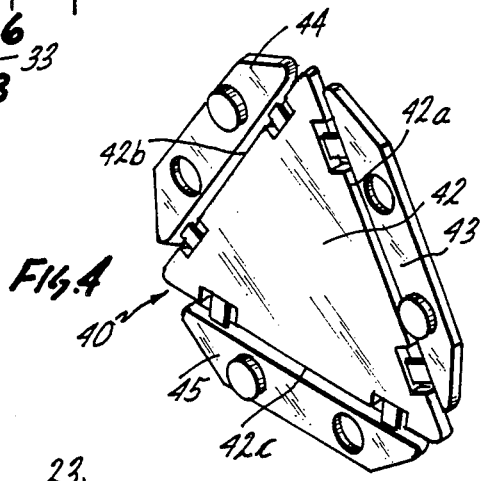
FIG. 4 is a perspective view of another one of the construction elements used in constructing the wheeled vehicle of FIG. 1.

The construction element 40 in FIG. 4 likewise has tabs 43–45 in hingedly coupled relation to the main triangular body portion 42, with the tabs 43–45 and connector means thereon configured identically to tabs 23–26 and connectors 32, 33. The connectors on tabs 43–45 of element 40 likewise alternate in inverted relation about the perimeter thereof. The length of the sides 42*a*, 42*b* and 42*c* of the main body portion 42 of element 40 are equal and identical to the length of the sides 22*a*–22*d* of the main body portion 22 of element 20. The tabs 43–45 are identical in dimensions and angles to the dimensions and angles of tabs 23–26.

By the simplification of the configuration, dimensions and number of plate like construction elements 20 and 40, enclosed geometrical configurations may be readily created by the relatively unskilled to produce such objects as the vehicle 15 shown in FIGS. 1 and 2.

Figure 8:
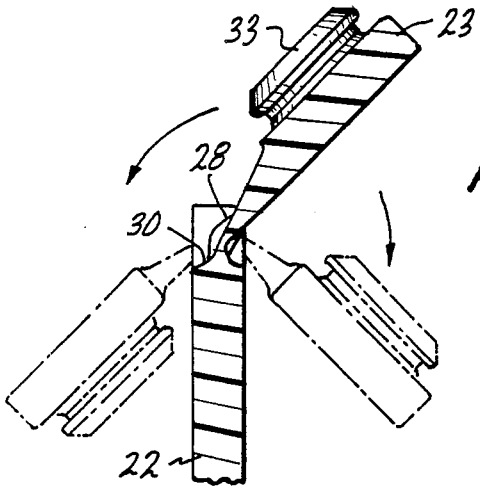
FIG. 8 is a cross-sectional view of a portion of the construction element of FIG. 3 as viewed generally along line 8—8 thereof with dotted lines depicting pivoted positions of the tab.
Figure 9:
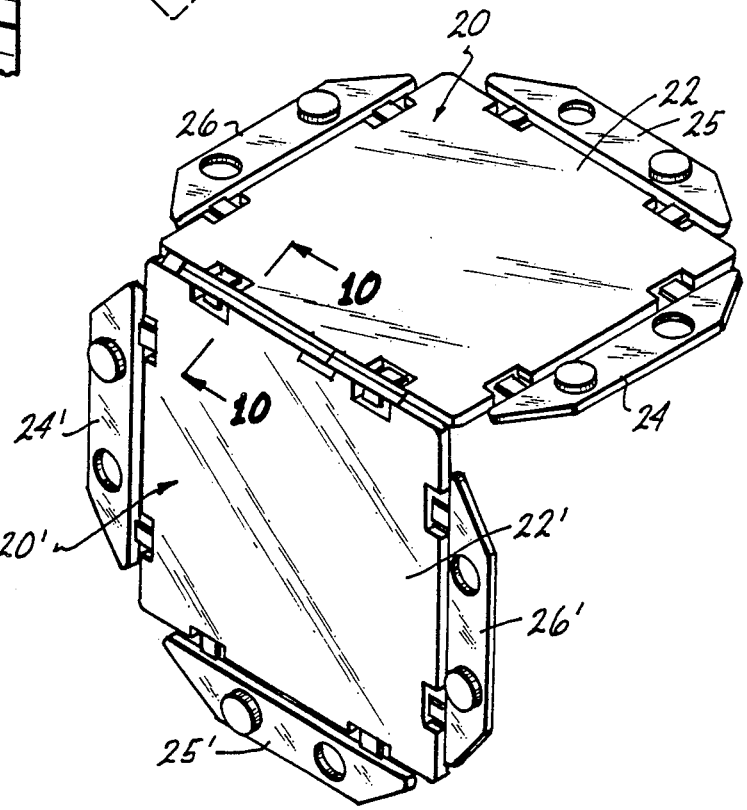
FIG. 9 is a perspective view of two of the construction elements of FIG. 3 interconnected and pivoted relative to one another.

FIG. 8 depicts the flexibility of the hinge 28 and shows in dotted lines the various positions of pivoting assumable by tab 23 along with its connector 33, while FIG. 9 depicts two four sided construction elements 20 and 20' interconnected in right angular relation. FIG. 10 depicts, in cross-section, the interconnection of the two elements 20 and 20' of FIG. 9 with the element 20 rotated through an angle of 180 degrees relative to element 20'. Correspondingly, FIG. 11 depicts in side elevation the two elements 20 and 20', in solid lines in overlying relation, with pivoting in a counterclockwise direction through the angle indicated by the arrow to the dotted line position encompassing approximately 300 degrees, thus illustrating the flexibility of angular positioning of the elements.

As shown in FIGS. 8 through 11, at any connection of one tab 23 to another tab 23', the construction elements 20 and 20' may readily be pivoted to any angle convenient for the object being created, subject however, to a limitation in the event another construction element is to interconnect, by way of example, with tabs 24 and 26' of the assembly shown in FIG. 9. In such event, if a construction element 40 is to be connected, a 60 degree angle between the two elements 20 and 20' is all that is required, and correspondingly, a 90 degree angle if another element 20 is to be connected in orthogonal relation to the two elements 20, 20' depicted.

Referring again to FIGS. 1 and 2, the upper pivoted shell portion has been created by a side construction element 20 connected to a triangular construction element 40 which is in turn connected to another square element 20, and so on, with the shell then being covered with yet another top element, designated 19. A simulated tail section is then added by use of two triangular elements 40 with an interconnecting shaft member 70. The tabs of the interconnected elements 20 and 40 are positioned in an outward orientation which enables the addition of shaft members 70, which are in turn necessary for attachment of the wheeled elements 60 and 61 as will be described in connection with FIGS. 12 and 13. It is to be emphasized that the tabs 23–26, etc., are not intended for connection in any orientation other than in an aligned orientation, that is, the trapezoid of one has the long base side thereof aligned with the long base side of the interconnected tab.

Referring now to FIG. 12, the shaft 70 is a rod member having one end thereof configured as a well 70*a* and the other end thereof configured as a pin 70*b*, each being configured substantially identically to the pin 32*b* configuration and well 32*a* configuration previously decribed. As shown in FIG. 12, two shafts 70 and 70' are connected between opposing tabs 23 and 25 of construction element 20 which are in generally perpendicular relation to the main body portion 22 thereof. The wheel element 60 includes a body portion 62 having a forked end 62*a* for rotatably receiving therein a wheel 64. Secured to the aft end of the body portion 62 in generally parallel relation to the axis of rotation of the wheel 64 are first and second spaced horseshoe-shaped clip members 66 and 68 having the open ends thereof positioned in an upward slightly angularly disposed direction for interconnection with the shaft members 70 and 70', respectively. Although not shown, it is to be understood that the wheel member 61 in FIGS. 1 and 2 will have a body portion with a pair of wheels attached to the outer ends of an axle with a similar pair of clip members attached to the body thereof for attachment to an appropriate construction element at the rear thereof.

With the tabs in generally orthogonal relation to the plane of the main body portion, such as body 22 of element 20, structural rigidity is provided to otherwise thin planar members. This rigidity enables the building of bridges and other structural objects. While not shown other construction elements may readily be derived within the teachings of the instant disclosure. While there has been shown and described a preferred embodiment, it is to be understood that various other adaptations and modifications may be made within the spirit and scope of the invention.

We claim:

1. In a construction set for constructing three dimensional objects, a unitary construction element comprising:

a generally planar main body portion having at least three sides of the same length;

spaced recesses in at least one of said sides having living hinges extending therefrom in a direction generally perpendicular to said at least one side;

a tab having a side thereof secured to the other end of said living hinges with said tab side in proximate spaced relation to said at least one side; and first and second substantially identical aligned connector means on said tab each equally spaced from the midpoint of the length of said tab and each being of a cup-shaped configuration with said first connector means being in inverted relation to said second connector means, each of said cup-shaped connector means forming (a) a pin portion extending from one surface of said tab, and (b) a well portion in the opposite surface of said tab, said well portion being in axial alignment with said pin portion and being configured for frictional engagement with a corresponding one of said pin portions on another construction element having a like tab.

2. The combination according to claim 1 wherein each side of said main body portion includes a like configured recess, hinge, tab and connector means arrangement.

3. The combination according to claim 2 wherein the length of said tab side is less than the length of said main body portion side.

4. The combination according to claim 1 wherein said construction element includes three sides and each side of said main body portion includes a like configured recess, hinge, tab and connector means arrangement.

* * * * *